United States Patent [19]

Udell

[11] Patent Number: 4,573,605

[45] Date of Patent: Mar. 4, 1986

[54] REPLACEABLE CLOSURE ARRANGEMENT

[75] Inventor: Theodore H. Udell, West Chester, Pa.

[73] Assignee: Container Corporation of America, Chicago, Ill.

[21] Appl. No.: 730,724

[22] Filed: May 6, 1985

[51] Int. Cl.[4] ..... B65D 53/00

[52] U.S. Cl. ..... 220/304

[58] Field of Search ..... 220/288, 304, 295

[56] References Cited

U.S. PATENT DOCUMENTS 3,432,069 3/1969 Craig ..... 220/304
3,437,231 4/1969 Carpenter, Jr. ..... 220/304
4,114,779 9/1978 Stoll, III ..... 220/288
4,164,304 8/1979 Roberson ..... 220/304

FOREIGN PATENT DOCUMENTS 403744 2/1968 Australia ..... 220/304

*Primary Examiner*—George T. Hall
*Attorney, Agent, or Firm*—Richard W. Carpenter

[57] ABSTRACT

An externally and internally threaded replaceable closure device adapted to be threadably interposed between a container neck and a closure plug.

9 Claims, 5 Drawing Figures

REPLACEABLE CLOSURE ARRANGEMENT

BACKGROUND OF THE INVENTION

1. Field of the Invention

This invention relates generally to any container closures, and more particularly to a replaceable closure arrangement for a molded plastic drum.

2. Description of the Prior Art

A prior art search conducted in the United States Patent and Trademark Office disclosed the following U.S. Pat. Nos.: 2,138,871; 2,154,812; 2,212,423; 2,277,713; 2,308,089; 3,923,192; 4,066,181; 4,114,779; 4,316,318.

None of the prior art patents uncovered in the search discloses a replaceable closure arrangement including an externally and internally threaded replaceable closure device adapted to be received between a container neck and a closure plug and having integral but detachable means for preventing further relative rotation between the closure device and the container after the former has been threadably received within the latter.

SUMMARY OF THE INVENTION

One of the problems encountered when using either an all plastic container, or a composite container with a plastic liner, is preservation of the integrity of the closure arrangement.

When a container closure consists of a threaded neck receiving a threaded plug, if damage occurs to the container neck threaded area, the entire drum has to be discarded. This is inefficient and extremely costly.

It is, therefore, a primary object of this invention to provide a replaceable closure arrangement which includes the use of a replaceable adaptor or intermediate closure device that can be received within the neck of a plastic drum and in turn receive a closure plug.

A more specific object of the invention is the provision, in a device of the type described, of means for preventing further relative rotation between a replaceable closure device and the neck of the container within which it is positioned, after the former has been received within the latter.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 3:
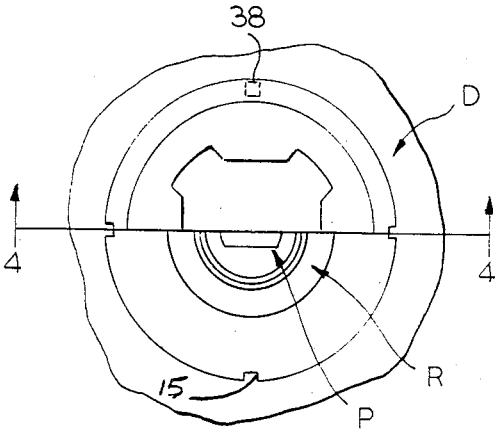
FIG. 3 is a top plan view of the structure illustrated in FIG. 2.
Figure 1:
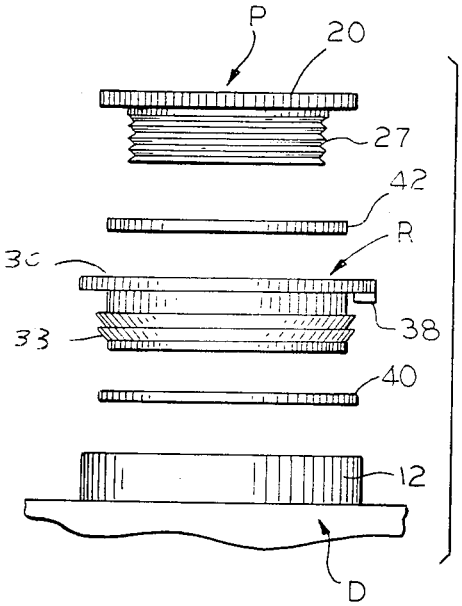
FIG. 1 is a fragmentary exploded view of a container closure arrangement embodying features of the invention.
Figure 2:
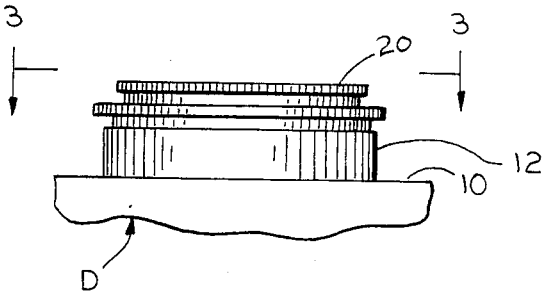
FIG. 2 is a fragmentary side elevational view of the structure illustrated in FIG. 1, with the container, intermediate closure, and closure plug shown in threaded engagement with each other.
Figure 4:
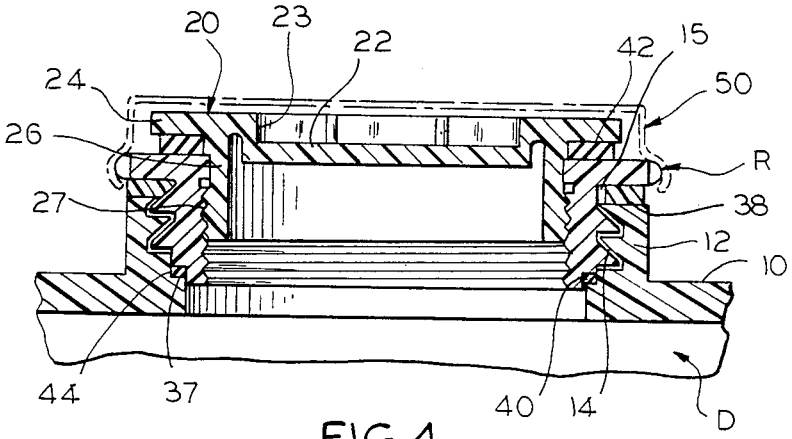
FIG. 4 is a fragmentary vertical sectional view taken on line 4—4 of FIG. 3.

Turning now to the drawings for a better understanding of the invention, and particularly to FIGS. 1 and 4, it will be seen that the novel closure arrangement includes a replaceable intermediate closure device, indicated generally at R, which is adapted to be threadably received between the internally threaded neck of a container, such as a blow-molded plastic drum D, and an externally threaded closure plug indicated generally at P.

Drum D, as best seen in FIG. 4, includes a top wall 10 having projecting upwardly therefrom an integral neck indicated at 12. Neck 12 is provided with internal threads 14 and is adapted to receive a closure plug P in a conventional closure arrangement. The arrangement of the present invention includes an intermediate closure device R which can be threadably interposed between neck 12 and closure plug P.

As best seen in FIGS. 1 and 4, closure plug P includes a round top wall 20 having a depressed center panel 22 and integral annular outer flange 24 which define a central recess 23.

Depending from top wall 20 is a generally cylindrical skirt 26 having external threads indicated generally at 27.

Figure 5:
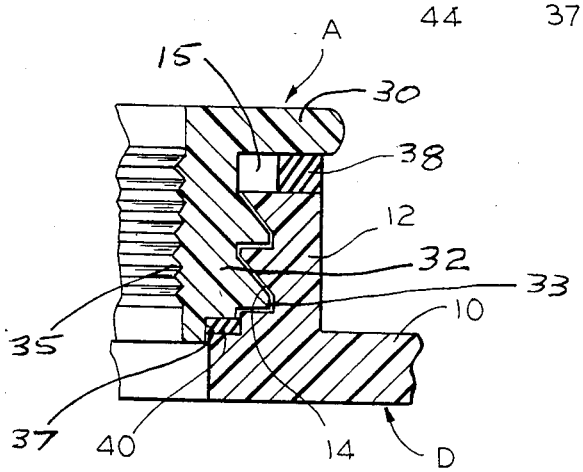
FIG. 5 is an enlarged view of a portion of the structure illustrated in FIG. 4.

Now referring to FIGS. 1 and 5, it will be seen that the replaceable closure R, which is the essence of the present invention, includes an annular top wall or flange 30 having a cylindrical skirt 32 depending therefrom. Skirt 32 is provided with internal threads 35 and external threads 33. At its lower extremity, skirt 32 presents an annular recess 37 adapted to receive a gasket as described later in the specification.

As best seen in FIGS. 1 and 4, when the device is assembled, the replaceable closure R is threadably received within neck 12 of container D and is sealed relative thereto by means of a gasket 40 which is received within the recess 37 of skirt 32 and thereby interposed between the closure device and the container neck.

In order to prevent relative rotation between the intermediate replaceable closure device and the container neck, after the former has been threadably received within the latter, there is provided a lock tab 38 which is formed integrally with and depends from flange 30 of the replaceable closure device. Tab 38 is adapted to fit within a recess or notch 15 formed in the upper portion of the container neck. Once the replaceable closure device has been threaded into the container neck to the point where lock tab 38 is received in notch 15, it is impossible to reverse the process and unscrew the device without detaching the lock tab 38 from the adaptor flange 30. Thus, the replaceable closure device becomes, in effect, an integral part of the container neck.

In order to close the container, the conventional closure plug P is screwed into the closure device R. Sealing engagement is provided between the closure device and the plug by means of another gasket 42 inserted between the flange 24 of the closure plug and flange 30 of the closure device.

The structure is such that it lends itself to the use of a conventional tamper-proof overcap 50 which may be positioned over the closure plug and the flange 30 of the replaceable closure device and clipped over the latter.

Thus, it will be seen that the invention provides a unique, intermediae closure device which is replaceable and which serves to protect the internal threads on the neck of an expensive container, such as a molded plastic drum, so that if the threads on the replaceable device are damaged, the device can be replaced with another replaceable closure device, and the drum can still function properly and receive a closure plug as previously described.

What is claimed is:

1. A closure arrangement for a container, such as a molded plastic drum, comprising, in combination:
   (a) a container having projecting therefrom an integral, cylindrical neck with internal threads for receiving a closure member with external threads;
   (b) a closure plug, including:
      (i) a cylindrical skirt with external threads;
      (ii) an annular flange extending radially outward from an upper portion of said skirt;
   (c) a replaceable closure device including:
      (i) a cylindrical skirt with external and internal threads for engagement with the threads of said container neck and said closure plug, respectively;
      (ii) an annular upper flange extending radially outward from an upper portion of said skirt and being adapted for engagement with the flange of said closure plug;
   (d) means for preventing further relative portion between said replaceable closure device and said container neck after the former has been threadably received within the latter.

2. A closure arrangement for a container, such as a molded plastic drum, comprising, in combination:
   (a) a container having projecting therefrom an integral, cylindrical neck with internal threads for receiving a closure member with external threads;
   (b) a closure plug, including:
      (i) a cylindrical skirt with external threads;
      (ii) an annular flange extending radially outward from an upper portion of said skirt;
   (c) a replaceable closure device including:
      (i) a cylindrical skirt with external and internal threads for engagement with the threads of said container neck and said closure plug, respectively;
      (ii) an annular upper flange extending radially outward from an upper portion of said skirt and being adapted for engagement with the flange of said closure plug.

3. An arrangement according to claim 2 and including means for preventing further relative rotation between said replaceable closure device and said container neck after the former has been threadably received within the latter.

4. An arrangement according to claim 3 wherein said means includes a tab projecting downwardly from the underside of said replaceable closure device flange for receipt within a complementary opening in said container neck.

5. An arrangement according to claim 2, and including means for providing sealing engagement between said replaceable closure device and said container neck.

6. An arrangement according to claim 2, and including means for providing sealing engagement between said replaceable closure device and said closure plug.

7. An arrangement according to claim 2, and including means providing sealing engagement between said closure device and said container and said plug.

8. An arrangement according to claim 7, wherein said means for providing sealing engagement includes a pair of resilient annular gaskets interposed between said replaceable closure device and said container neck and between said replaceable closure device and said closure plug, respectively.

9. In a replaceable closure arrangement for preserving a closure fitting on a large plastic molded container, such as a drum having an integral internally threaded neck projecting therefrom for receiving an externally threaded closure plug, a replaceable intermediate closure device adapted to be threadably interposed between said container neck and closure plug, said device comprising:
   (a) a cylindrical skirt having both external and internal threads for engagement with related threads of a container neck and closure plug, respectively;
   (b) an integral annular flange extending radially outward from an upper portion of said skirt;
   (c) a detachable locking tab projecting downward from said flange and adapted to be received within a complementary opening in said container neck to prevent relative rotation between said replaceable closure device and said container neck.

* * * * *

UNITED STATES PATENT AND TRADEMARK OFFICE

CERTIFICATE OF CORRECTION

PATENT NO. : 4,573,605

DATED : March 4, 1986

INVENTOR(S) : Theodore H. Udell

It is certified that error appears in the above-indentified patent and that said Letters Patent is hereby corrected as shown below:

Column 3, line 27, change "portion" to read--rotation--.

Signed and Sealed this

Ninth Day of November, 1993

*Attest:*

*Attesting Officer*

Bruce Lehman

BRUCE LEHMAN

*Commissioner of Patents and Trademarks*